US009748654B2

(12) United States Patent
Teoh

(10) Patent No.: US 9,748,654 B2
(45) Date of Patent: Aug. 29, 2017

(54) ANTENNA SYSTEMS WITH PROXIMITY COUPLED ANNULAR RECTANGULAR PATCHES

(71) Applicant: Laird Technologies, Inc., Earth City, MO (US)

(72) Inventor: Xin Wen Teoh, Penang (MY)

(73) Assignee: Laird Technologies, Inc., Earth City, MO (US)

( * ) Notice: Subject to any disclaimer, the term of this patent is extended or adjusted under 35 U.S.C. 154(b) by 247 days.

(21) Appl. No.: 14/571,580

(22) Filed: Dec. 16, 2014

(65) Prior Publication Data

US 2016/0172763 A1 Jun. 16, 2016

(51) Int. Cl.

| | |
|---|---|
| ***H01Q 1/24*** | (2006.01) |
| ***H01Q 9/04*** | (2006.01) |
| *H01Q 19/00* | (2006.01) |
| *H01Q 1/52* | (2006.01) |

(52) U.S. Cl.

CPC ..... *H01Q 9/0421* (2013.01); *H01Q 9/045* (2013.01); *H01Q 1/521* (2013.01); *H01Q 9/0407* (2013.01); *H01Q 9/0464* (2013.01); *H01Q 19/005* (2013.01)

(58) Field of Classification Search

CPC ..... H01Q 9/0421; H01Q 5/40; H01Q 5/371; H01Q 1/1214; H01Q 1/3275; H01Q 21/28; H01Q 9/0464; H01Q 1/521; H01Q 9/0407

USPC ..... 343/700 MS, 702, 711–713, 833–834, 343/841, 846, 848, 725

See application file for complete search history.

(56) References Cited

U.S. PATENT DOCUMENTS

| | | | | |
|---|---|---|---|---|
| 6,456,249 | B1 * | 9/2002 | Johnson | H01Q 1/243 343/700 MS |
| 6,922,171 | B2 | 7/2005 | Annamaa et al. | |
| 7,692,601 | B2 * | 4/2010 | Bisiules | H01P 5/103 343/797 |

(Continued)

FOREIGN PATENT DOCUMENTS

| | | |
|---|---|---|
| TW | 200929687 A | 7/2009 |
| TW | I416800 B | 11/2013 |
| WO | WO 2012/112022 | 8/2012 |

OTHER PUBLICATIONS

International Search Report and Written Opinion dated Mar. 31, 2016 for PCT Application No. PCT/US2015/065733 filed Dec. 15, 2015 which claims priority to the instant application; 11 pages.

(Continued)

*Primary Examiner* — Hoang Nguyen
*Assistant Examiner* — Awat Salih
(74) *Attorney, Agent, or Firm* — Harness, Dickey & Pierce, P.L.C.

(57) ABSTRACT

Exemplary embodiments are provided of antennas and antenna systems including the same. In an exemplary embodiment, an antenna generally includes a radiating patch element having an annular rectangular shape. An antenna ground plane is spaced apart from the radiating patch element. A feeding element electrically coupled to the radiating patch element via proximity coupling. The antenna also includes at least two shorting elements electrically coupling the radiating patch element to the antenna ground plane. In other exemplary embodiments, the antenna systems include at least one active GPS antenna, at least one passive antenna, and an isolator.

18 Claims, 20 Drawing Sheets

(56) References Cited

U.S. PATENT DOCUMENTS 8,009,110 B2 * 8/2011 Teng ..... H01Q 1/2266 343/702
8,228,238 B2 * 7/2012 Thiam ..... H01Q 9/0421 343/700 MS
2002/0145569 A1 10/2002 Onaka et al.
2004/0263392 A1 * 12/2004 Bisiules ..... H01Q 1/246 343/700 MS
2005/0078039 A1 * 4/2005 Harano ..... H01Q 1/243 343/702
2005/0140549 A1 * 6/2005 Leelaratne ..... H01Q 9/0421 343/700 MS
2006/0082504 A1 * 4/2006 Chen ..... H01Q 1/243 343/700 MS
2008/0158066 A1 7/2008 Yu et al.
2010/0328164 A1 * 12/2010 Huynh ..... H01Q 1/243 343/702
2011/0063180 A1 * 3/2011 Su ..... H01Q 3/24 343/795
2011/0215978 A1 9/2011 Lindenmeier et al.
2012/0007781 A1 1/2012 Kim et al.
2012/0013521 A1 1/2012 Saliga et al.
2012/0154237 A1 * 6/2012 Ying ..... H01Q 1/48 343/833
2012/0299785 A1 * 11/2012 Bevelacqua ..... H01Q 9/42 343/702
2012/0319916 A1 * 12/2012 Gears ..... H01Q 1/525 343/841
2013/0082879 A1 * 4/2013 Fuchs ..... H01Q 5/328 343/700 MS
2013/0229315 A1 * 9/2013 Duzdar ..... H01Q 1/3275 343/713
2013/0234896 A1 * 9/2013 Sharawi ..... H01Q 9/0421 343/700 MS
2014/0139379 A1 * 5/2014 Bolin ..... H01Q 9/06 343/702
2015/0002349 A1 * 1/2015 Peng ..... H01Q 1/48 343/727
2015/0071137 A1 * 3/2015 Thiam ..... H01Q 9/0407 370/297
2016/0064807 A1 * 3/2016 Reed ..... H01Q 1/3275 343/713

OTHER PUBLICATIONS

Taiwan Office Action and Search Report for Taiwan application No. 104142069 filed Dec. 15, 2015 (published as 201630253 on Aug. 16, 2016) which claims priority to the instant application; dated Apr. 13, 2017; 6 pages.

* cited by examiner

698 MHz

824 MHz

894 MHz

960 MHz

1710 MHz

1880 MHz

1990 MHz

2170 MHz

698 MHz

824MHz

894 MHz

960 MHz

1710 MHz

1880 MHz

ANTENNA SYSTEMS WITH PROXIMITY COUPLED ANNULAR RECTANGULAR PATCHES

FIELD

The present disclosure generally relates to antenna systems with proximity coupled annular rectangular patches.

BACKGROUND

This section provides background information related to the present disclosure which is not necessarily prior art.

Antenna system design has been growing abruptly with complexity as the new technology vastly advances. The introduction of new frequency bands LTE/4G has led to the need of broader bandwidth for mobile stations, and the market is expecting antennas to be smaller, lower profile with better performance. The challenge in designing a low profile antenna is how to make it vertically polarized with omnidirectional radiation pattern despite the low profile requirement. A conventional planar inverted-F antenna has often been selected due to its small size and low profile application. But the conventional planar inverted-F antenna suffers from narrow bandwidth within the required form factor.

SUMMARY

This section provides a general summary of the disclosure, and is not a comprehensive disclosure of its full scope or all of its features.

According to various aspects, exemplary embodiments of antennas are disclosed. In an exemplary embodiment, an antenna includes a radiating patch element having an annular rectangular shape. An antenna ground plane is spaced apart from the radiating patch element. A feeding element electrically couples to the radiating patch element. The antenna also includes at least two shorting elements electrically coupling the radiating patch element to the antenna ground plane.

According to additional aspects of the present disclosure, exemplary embodiments of antenna systems are disclosed. In an exemplary embodiment, an antenna system includes an active global positioning satellite antenna and a passive antenna. The passive antenna includes an annular rectangular radiating patch element, an antenna ground plane spaced apart from the annular rectangular radiating patch element, a feeding element electrically coupling to the annular rectangular radiating patch element, and at least two shorting elements. The shorting elements electrically couple the annular rectangular radiating patch element to the antenna ground plane. The antenna system also includes an isolator configured to provide isolation between the active global positioning satellite antenna and the passive antenna.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 11A:
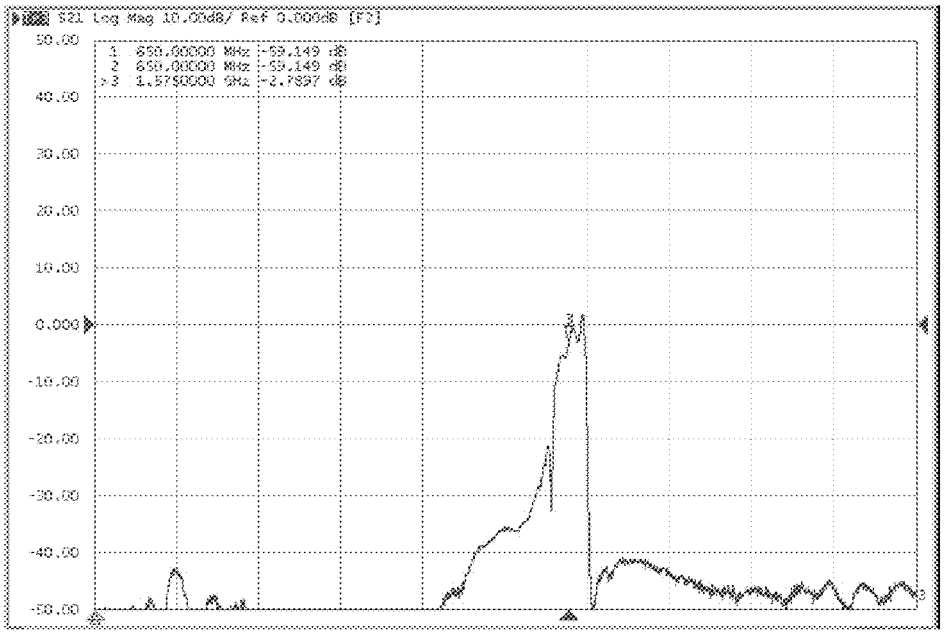
Figure 11B:
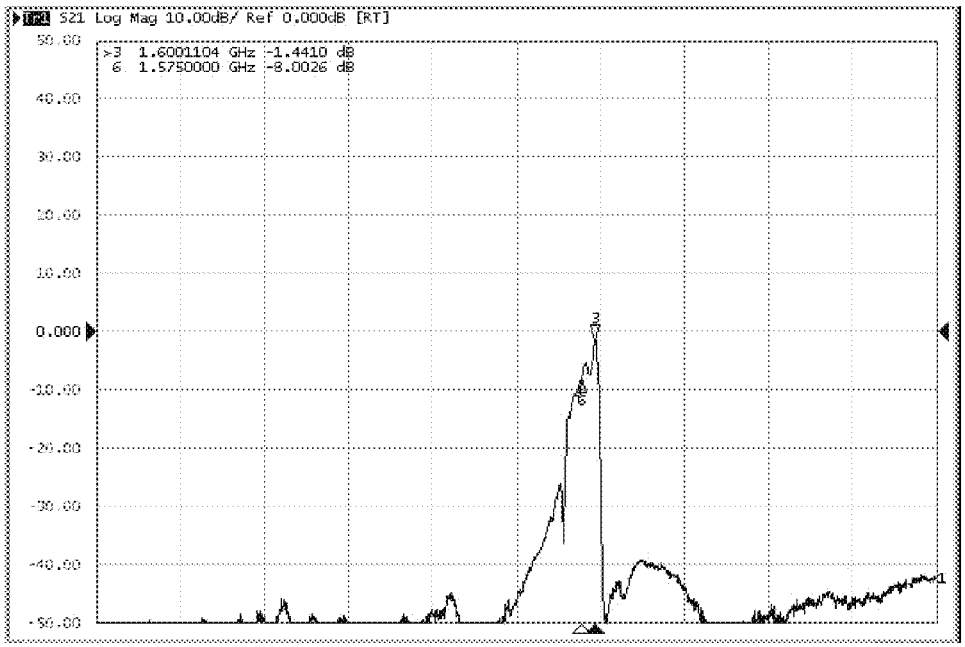
Figure 12:
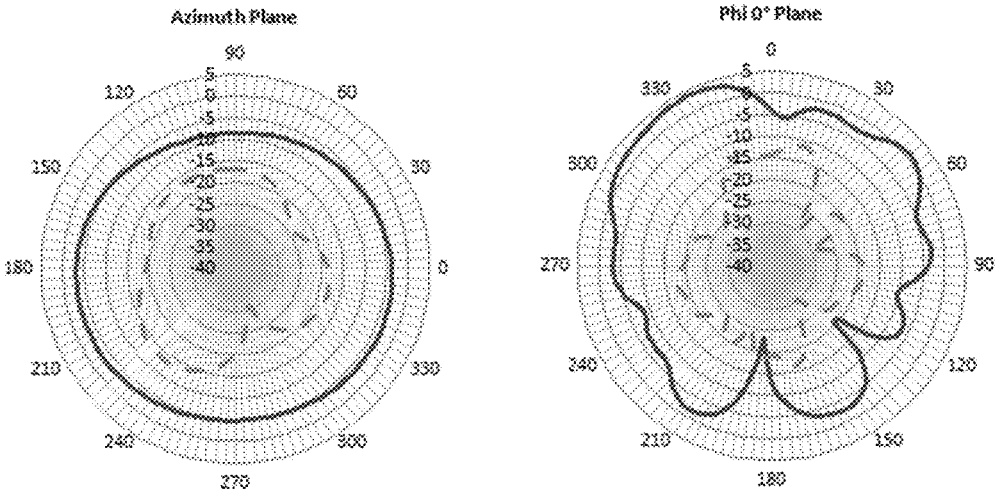
Figure 12:
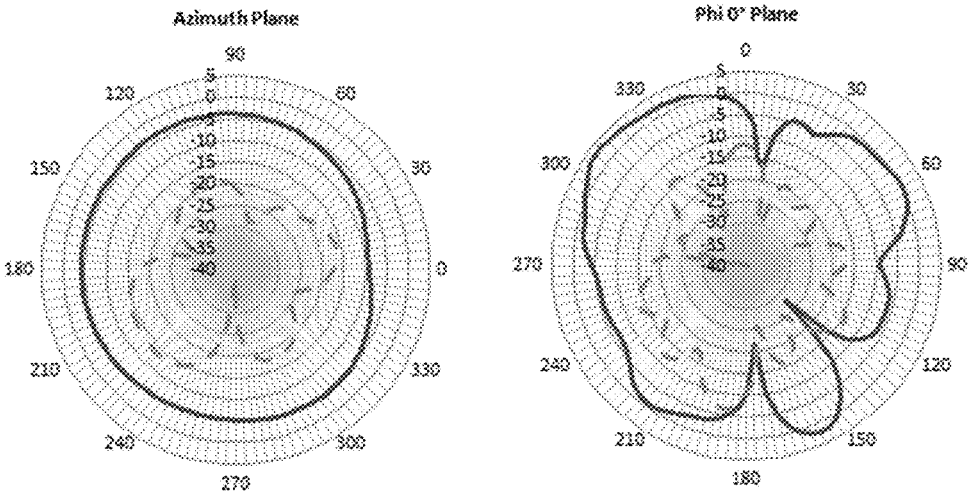
Figure 12:
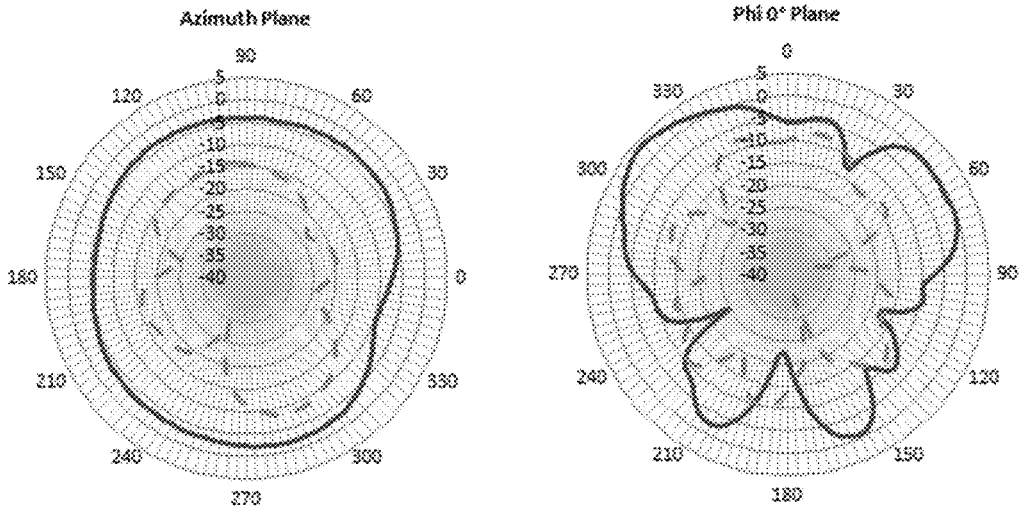
Figure 12:
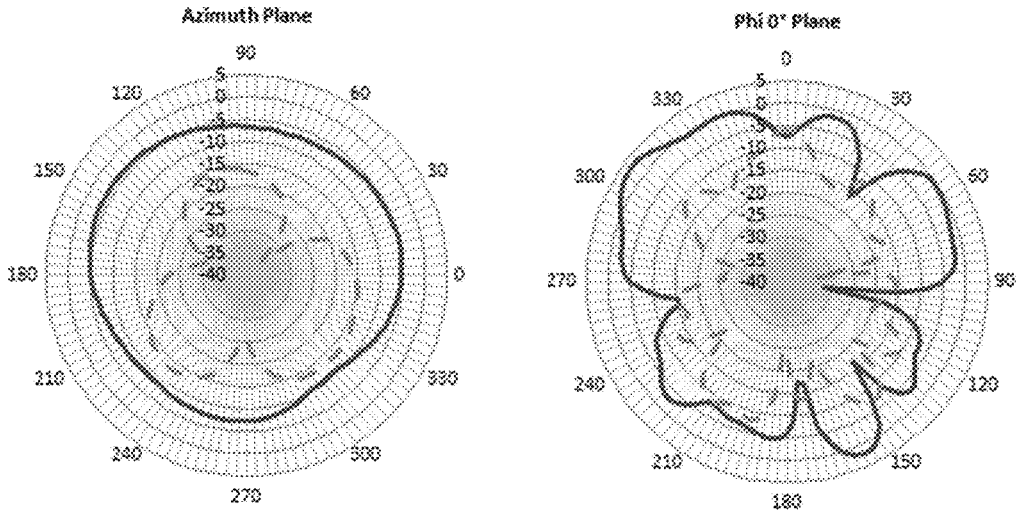
Figure 12:
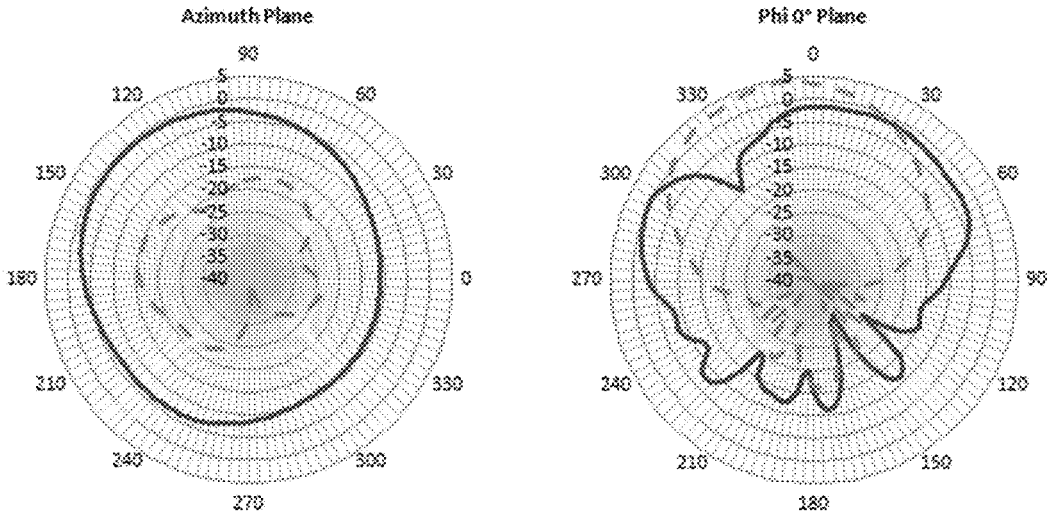
Figure 12:
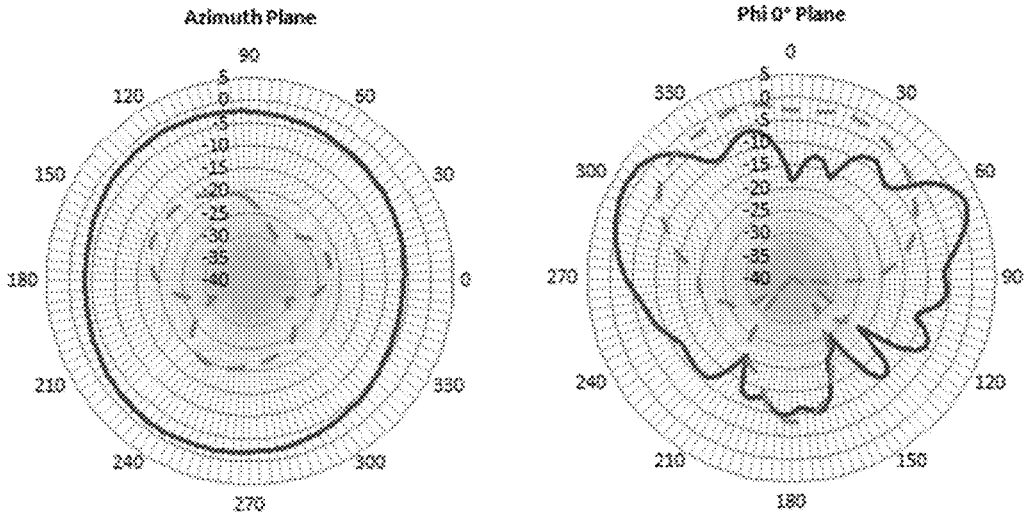
Figure 12:
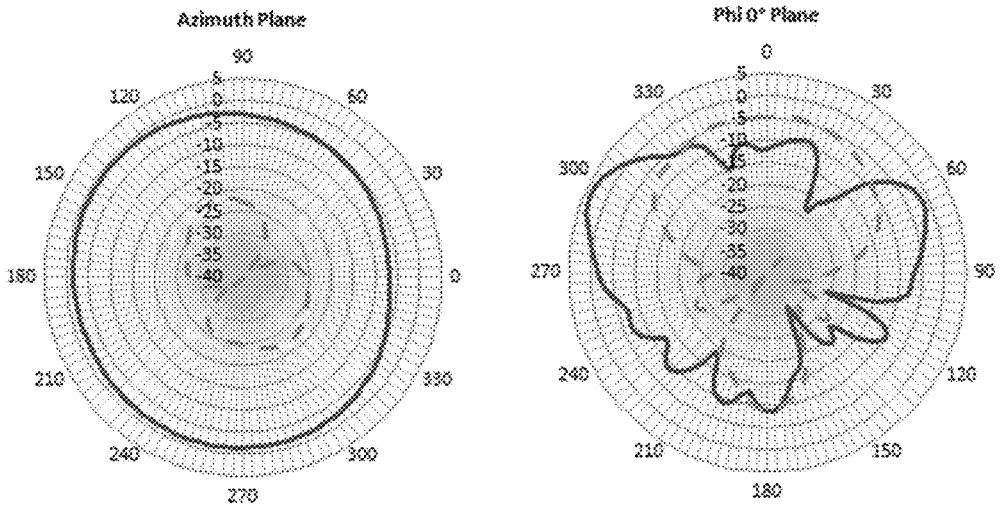
Figure 12:
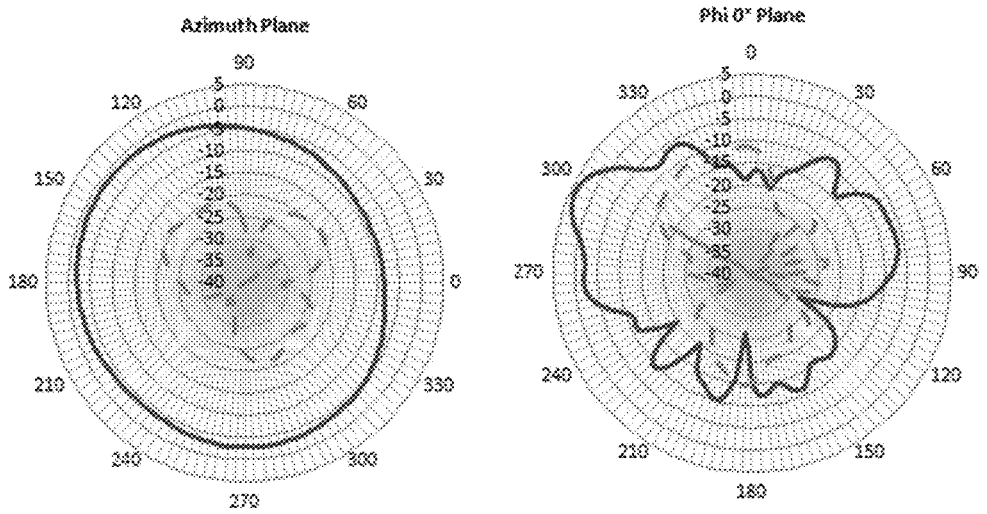
Figure 13:
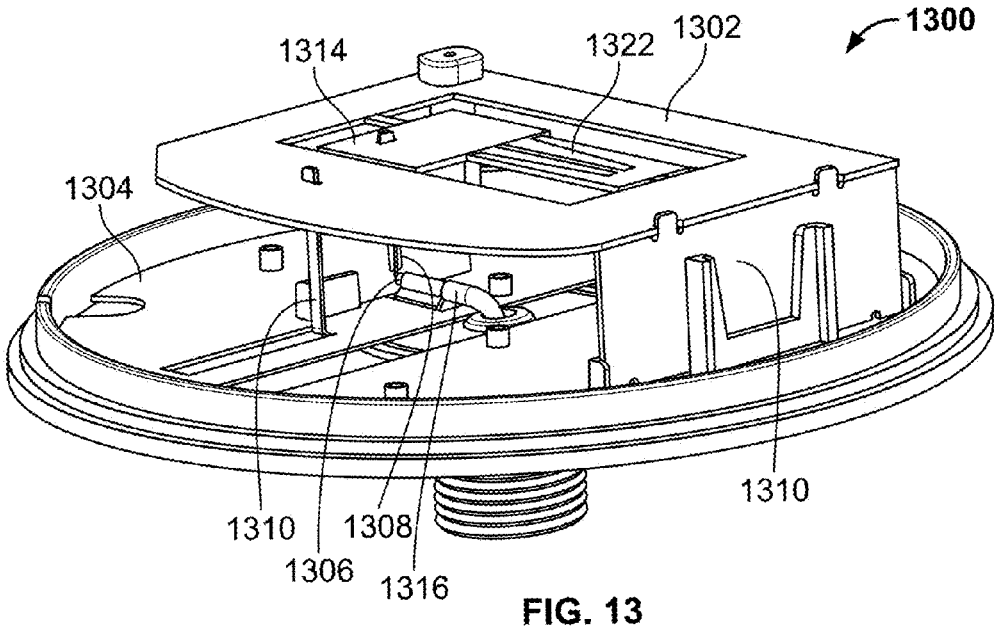
Figure 14:
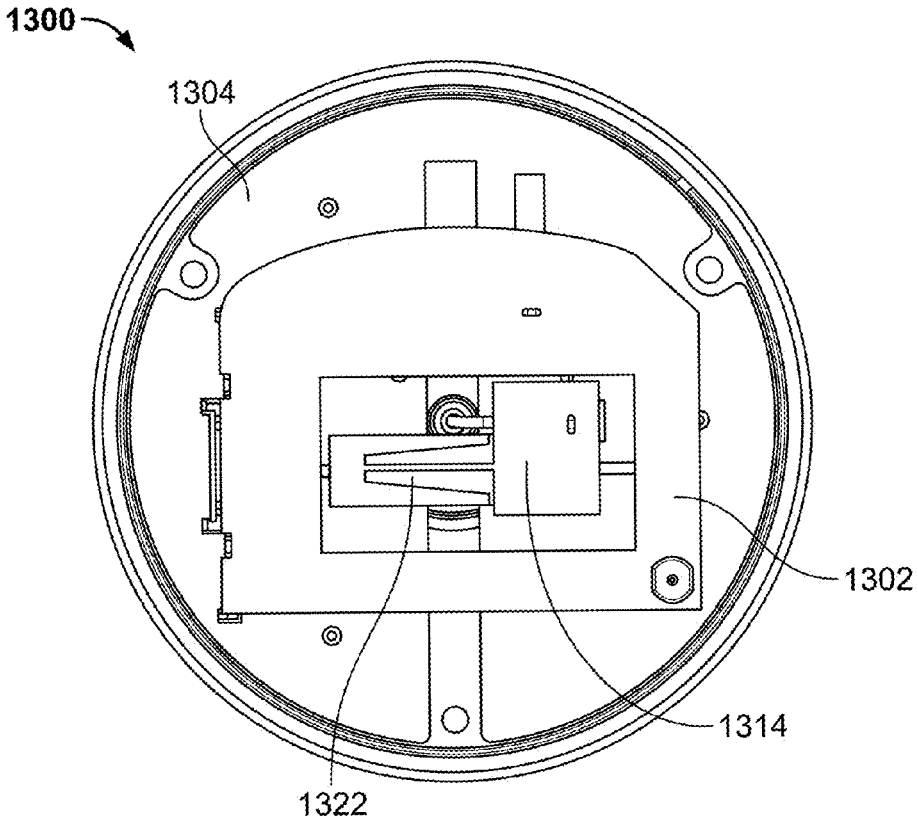
Figure 15:
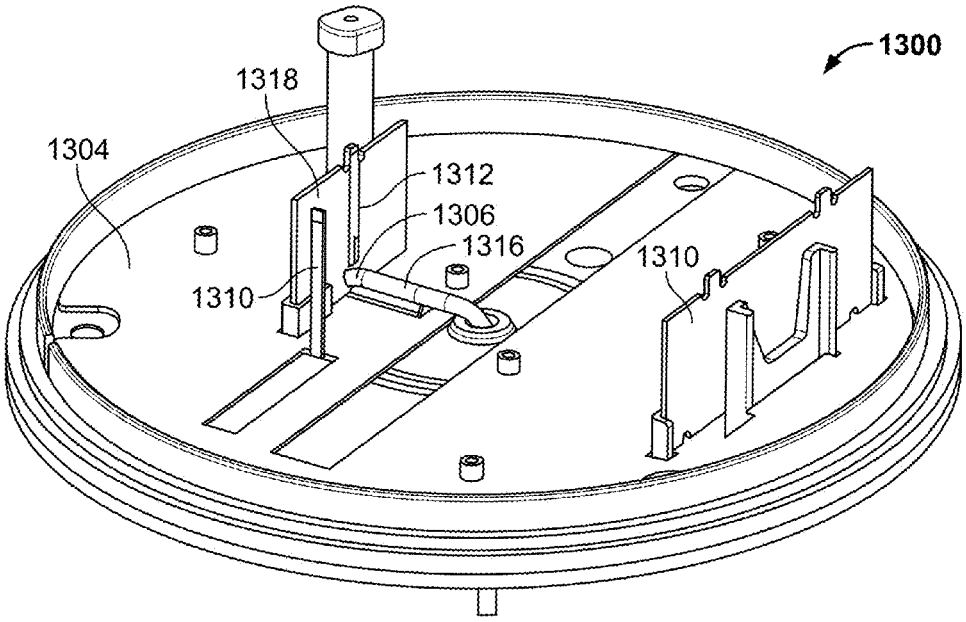
Figure 16:
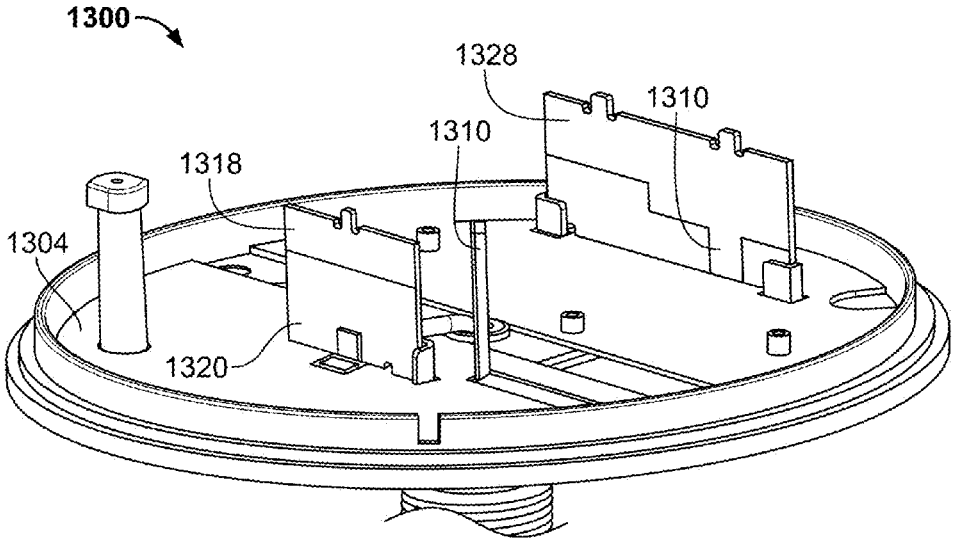
Figure 17:
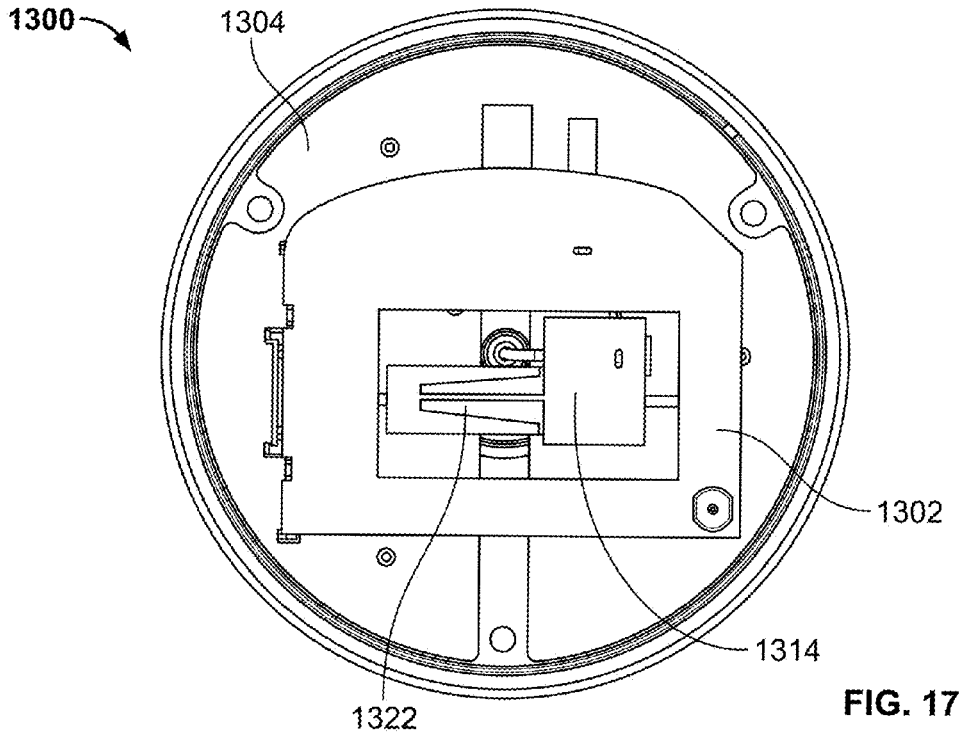
Figure 18:
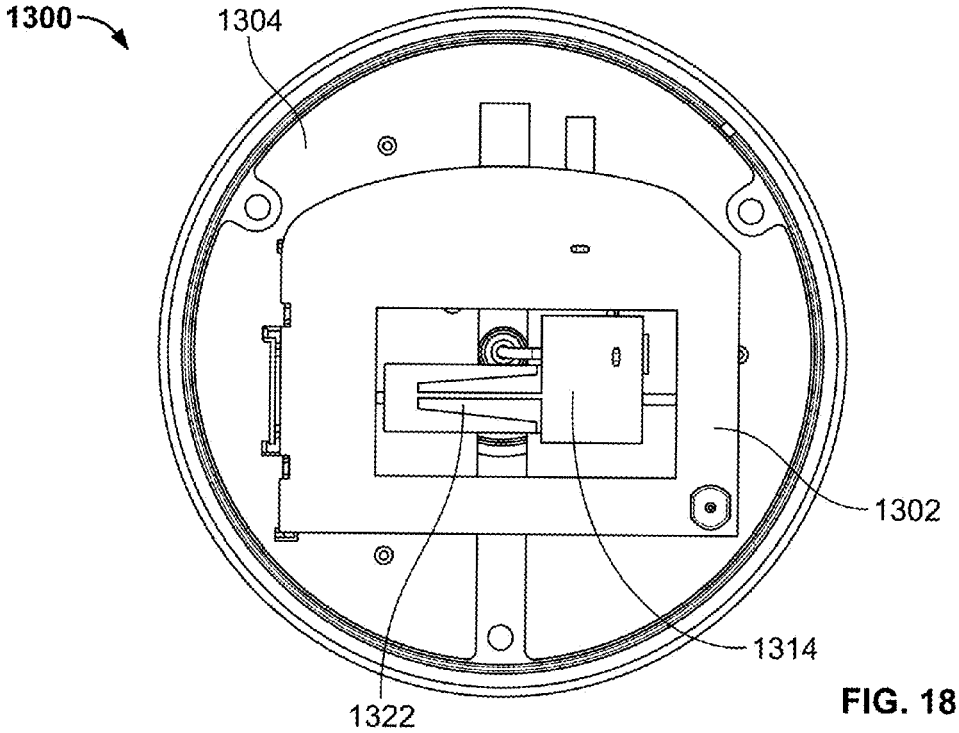
Figure 19:
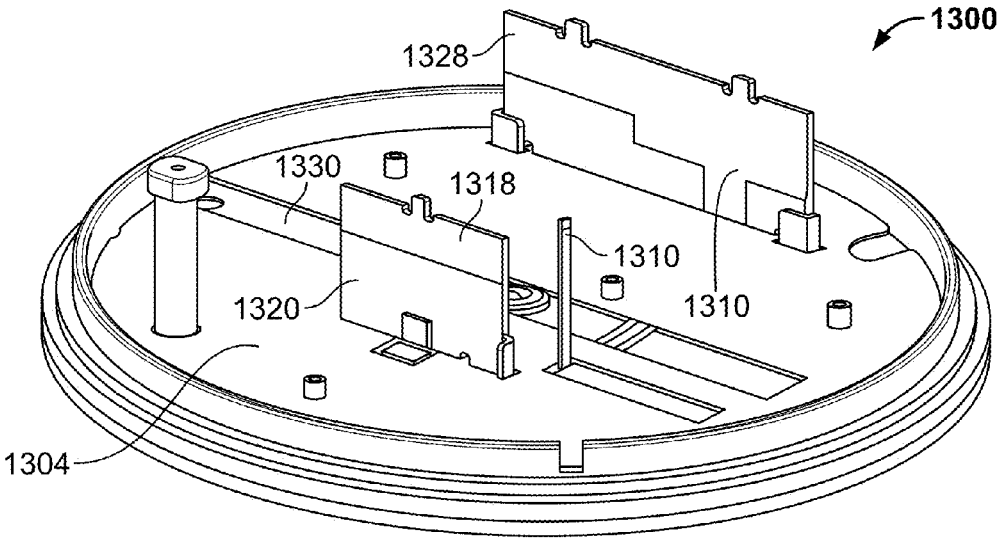
Figure 20:
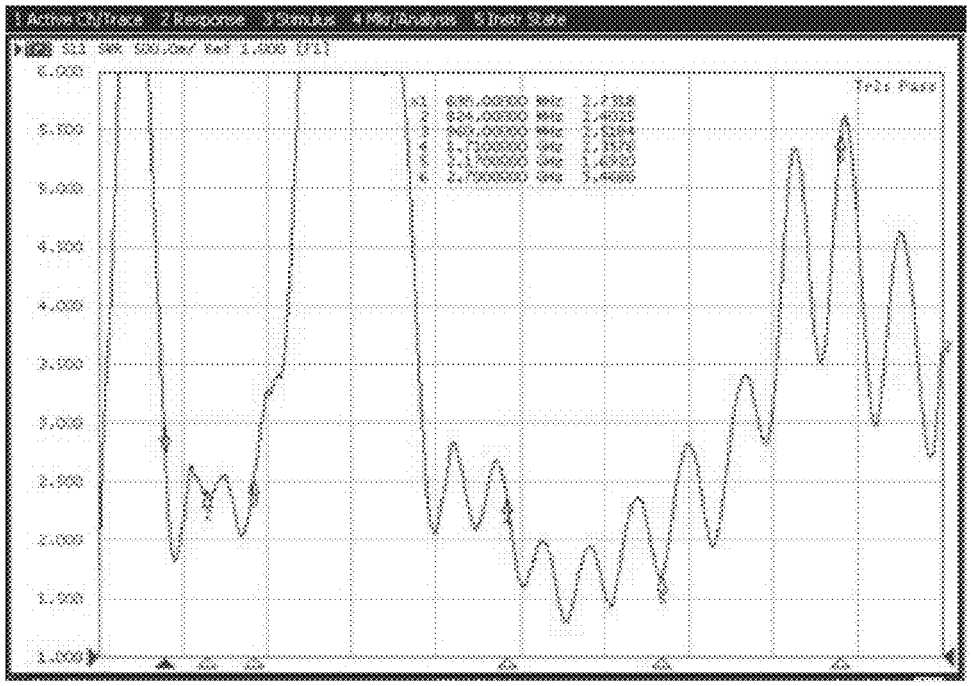
Figure 21:
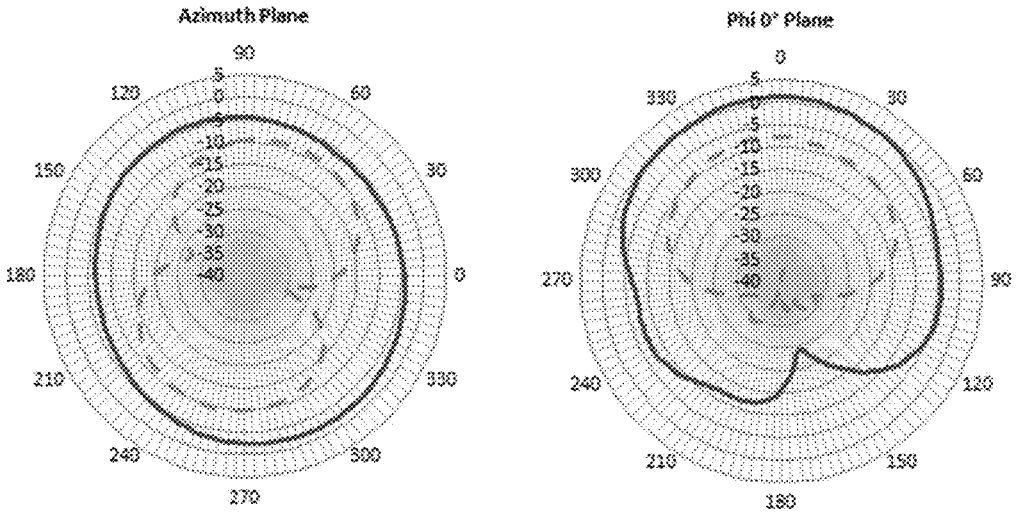
Figure 21:
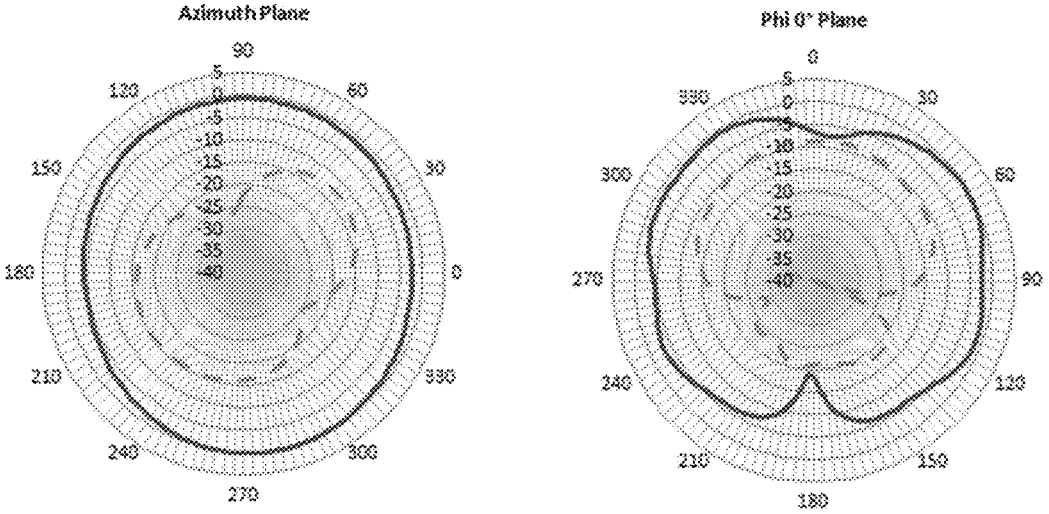
Figure 21:
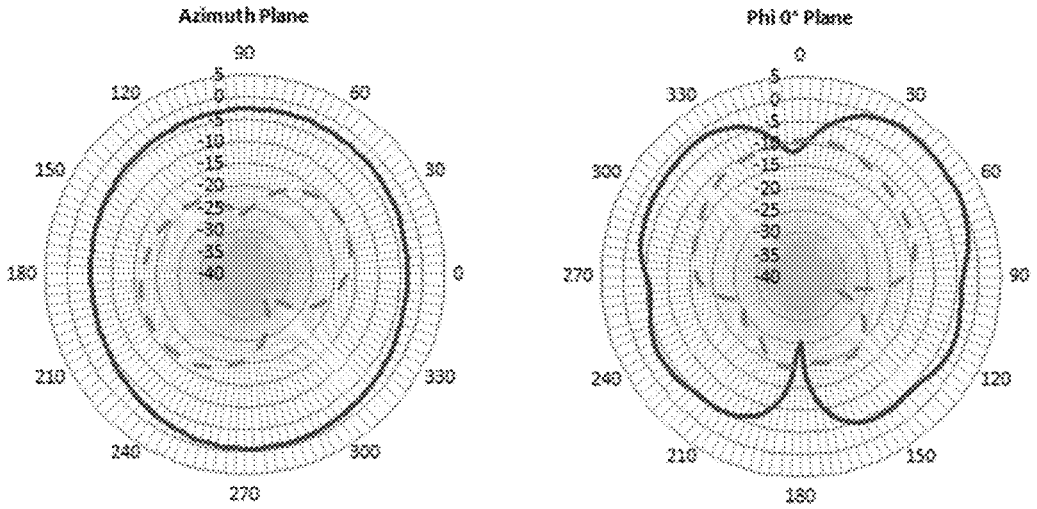
Figure 21:
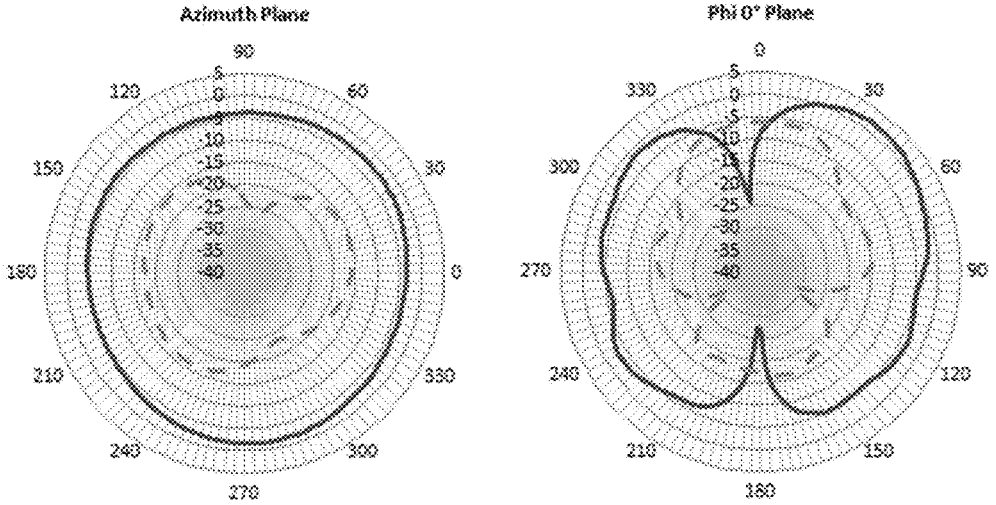
Figure 21:
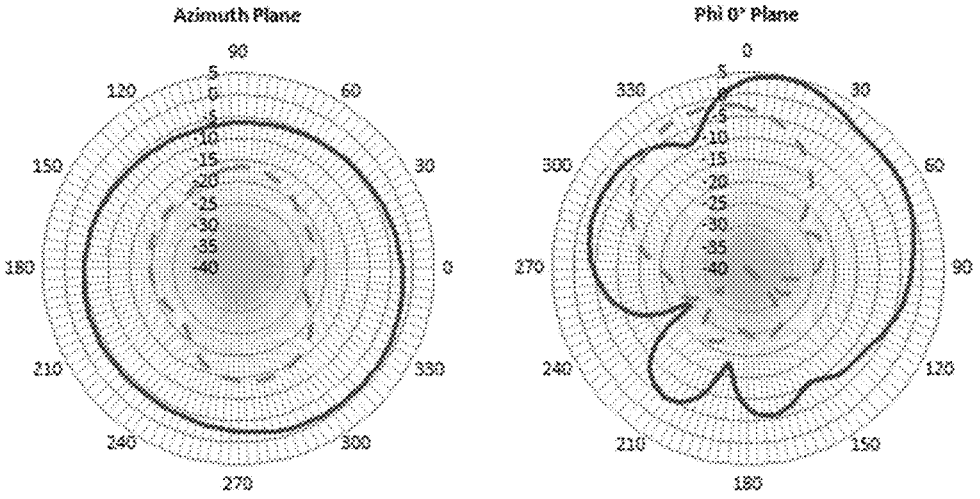
Figure 21:
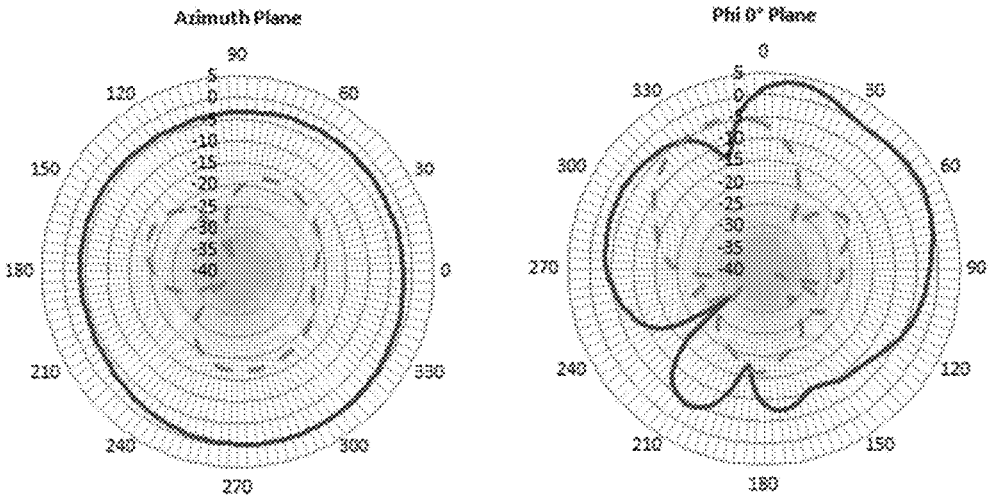
Figure 21:
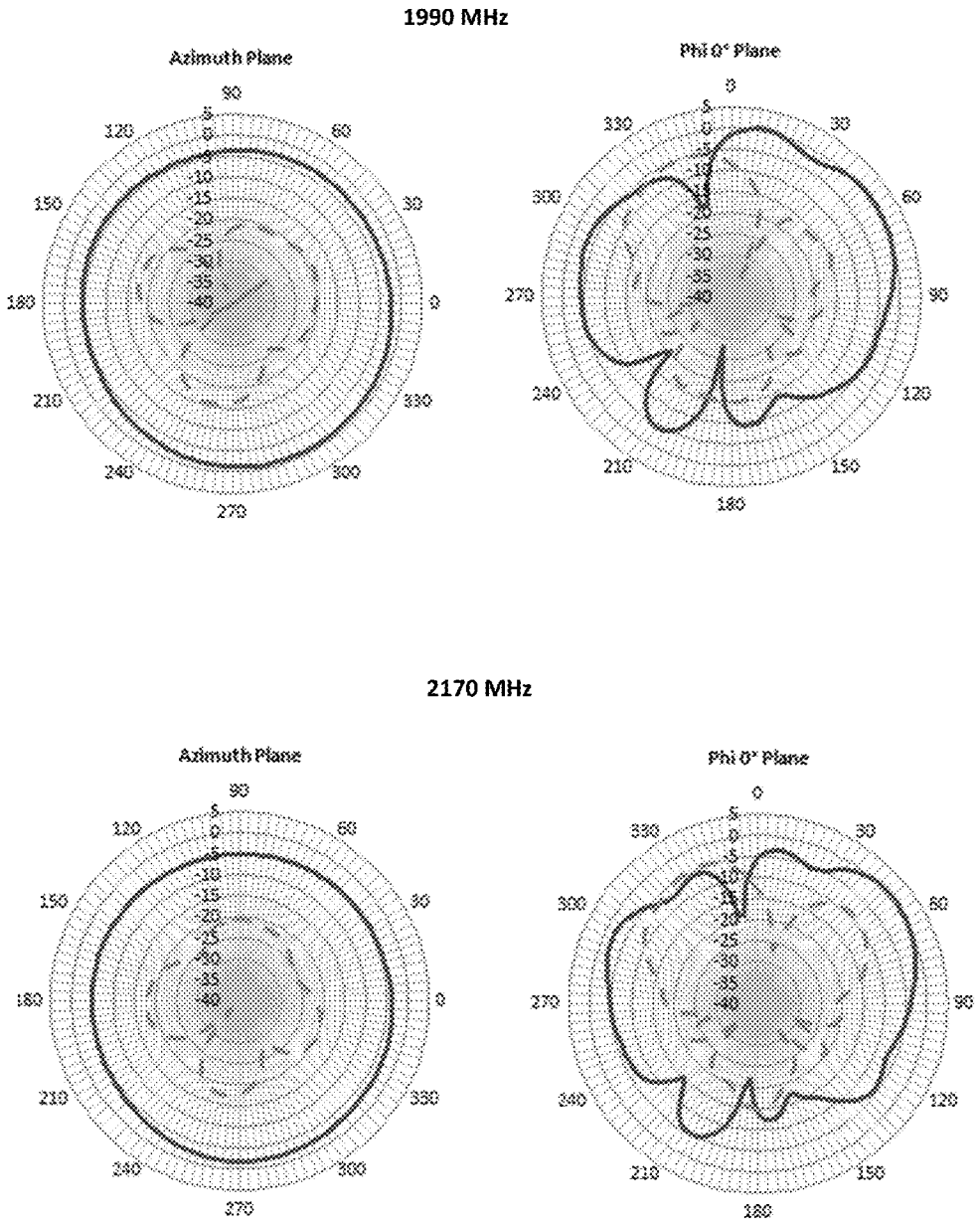

FIGS. 11*a* and 11*b* are exemplary line graphs illustrating isolation in decibels (dB) versus frequency without the isolator (FIG. 11*a*) and with the isolator (FIG. 11*b*) measured for the exemplary antenna system of FIGS. 1-9;

FIG. 12 illustrates radiation patterns (azimuth plane and phi 0° plane) for the antenna system shown in FIGS. 1-9 at frequencies of 698 MHz, 824 MHz, 894 MHz, 960 MHz, 1710 MHz, 1880 MHz, 1990 MHz, and 2170 MHz;

FIG. 13 is a perspective view of an antenna system or assembly according to another exemplary embodiment;

FIG. 14 is a top view of the antenna system of FIG. 13 rotated about a vertical axis;

FIG. 15 is a perspective view of a portion of the antenna system shown in FIG. 13;

FIG. 16 is a perspective view of the portion of the antenna system shown in FIG. 15 rotated about a vertical axis;

FIG. 17 is a top view of the antenna system shown in FIG. 13 highlighting a horizontal feed patch;

FIG. 18 is a top view of the antenna system shown in FIG. 17 highlighting an annular radiating patch and a tapered L-shaped slot;

FIG. 19 is another perspective view of the portion of the antenna system shown in FIG. 16 highlighting two shorting elements and an open-ended slot;

FIG. 20 is an exemplary line graph illustrating VSWR versus frequency measured from the exemplary antenna system of FIGS. 13-19; and FIG. 21 illustrates radiation patterns (azimuth plane and phi 0° plane) for the antenna system shown in FIGS. 13-19 at frequencies of 698 MHz, 824 MHz, 894 MHz, 960 MHz, 1710 MHz, 1880 MHz, 1990 MHz, and 2170 MHz.

DETAILED DESCRIPTION

Example embodiments will now be described more fully with reference to the accompanying drawings.

The inventors herein have recognized a need for good and/or improved bandwidth (e.g., from about 698-960 MHz and from about 1710-2170 MHz, etc.) for a conventional PIFA antenna with a low profile requirement (e.g., less than or equal to approximately 20 millimeters by 110 millimeters, etc.), reduced and/or eliminated the need for galvanic contact to a larger ground plane, good and/or improved vertical polarization radiation patterns, good and/or improved isolation between an active global positioning satellite (GPS) antenna and a cellular radiator, with both placed in close proximity, etc. Accordingly, disclosed herein are exemplary embodiments of antennas and antenna systems including the same (e.g., 100 (FIGS. 1-9), 1300 (FIGS. 13-19), etc.) that include one or more of the above mentioned features.

In some exemplary embodiments, an antenna may be a two port vehicular antenna, and may include a cellular radiator, an active GPS antenna, and an isolator. The antenna may have a broad bandwidth that covers a frequency range of about 698 MHz to about 960 MHz and/or about 1710 MHz to about 2170 MHz. The antenna may be mounted on a ground plane (e.g., a metallic ceiling of a vehicle, machine, etc.). The ground plane may be at least 30 centimeters in diameter. Thus, the antenna may be considered as ground dependent (e.g., have a smaller diameter, have a lower profile feature, etc.). A radiating element of the antenna (e.g., radiator, etc.) may not require galvanic contact to a ground plane of the vehicle, and may be considered to have proximity coupling with a suitable insulation height between the radiating element and the ground plane.

In some exemplary embodiments, an antenna may consist of a cellular radiator, having a broad bandwidth and operable in a frequency range of about 698 MHz to about 960 MHz and/or about 1710 MHz to about 2170 MHz. The antenna may have omnidirectional radiation patterns with a dominant vertical polarization at horizon across the operating frequency, with a lower profile and smaller diameter antenna assembly. The antenna may be mounted on a ground plane (e.g., a metallic ceiling of a machine, etc.), and may perform well with a ground plane diameter of more than about 30 centimeters. The antenna may be ground dependent with a small diameter and low profile form factor. The antenna may include a radiating element which does not require galvanic contact with the ground plane of the machine, and may be considered to have proximity coupling with a suitable insulation height (e.g., distance, etc.) between the radiating element and the ground plane.

Figure 1:
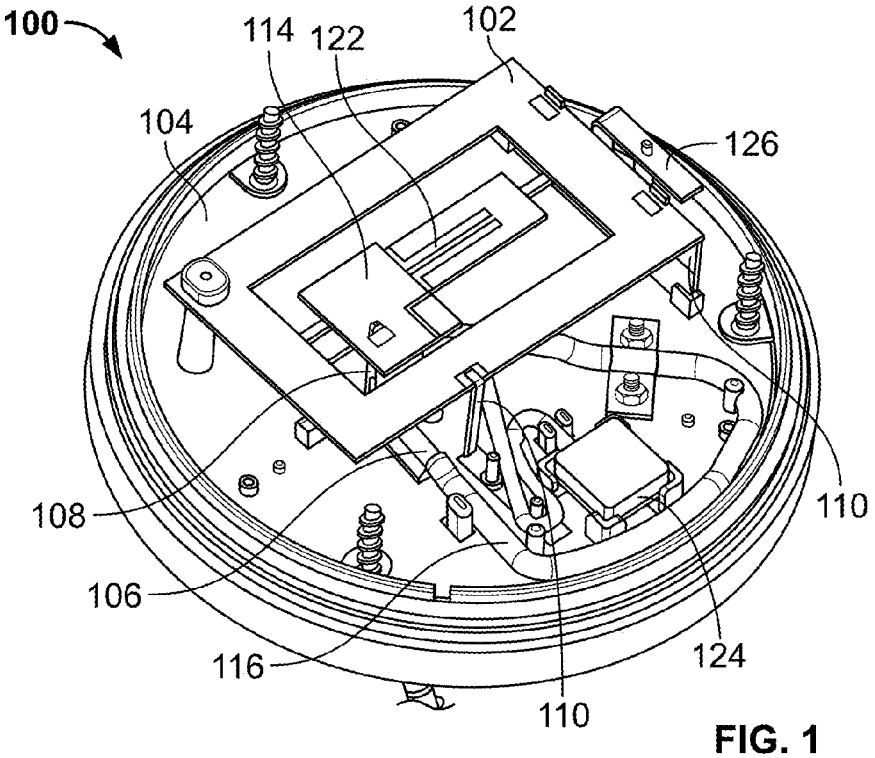
FIG. 1 is a perspective view of an antenna system or assembly according to an exemplary embodiment.
Figure 2:
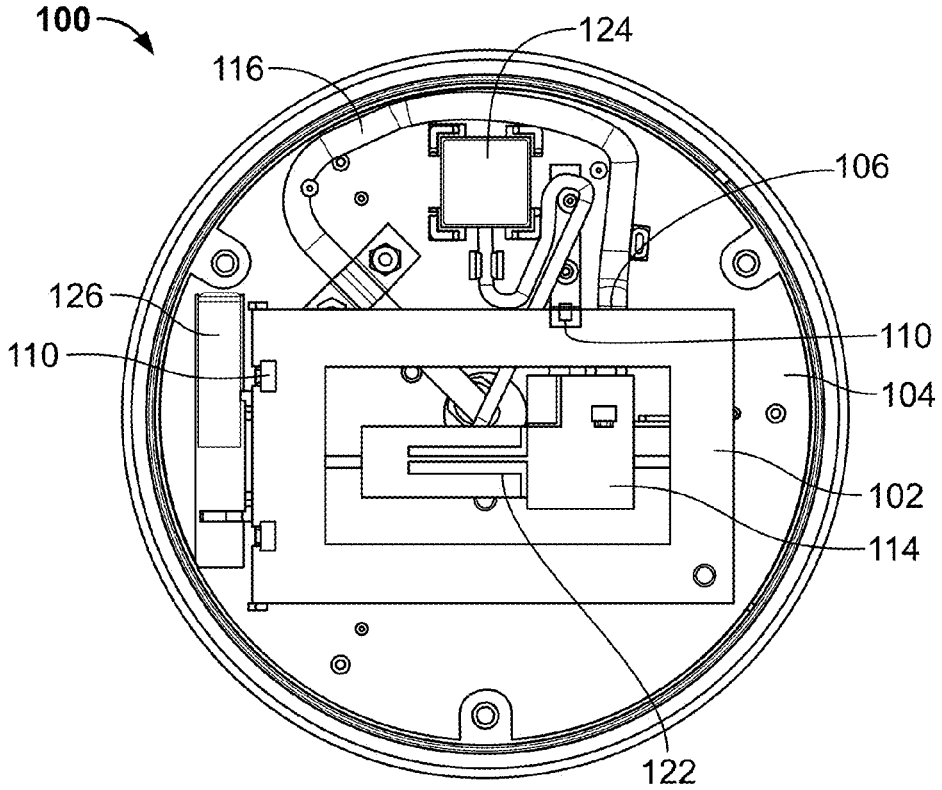
FIG. 2 is a top view of the antenna system shown in FIG. 1 rotated about a vertical axis.

Referring now to the figures, FIGS. 1 and 2 illustrate an exemplary embodiment of an antenna system or assembly embodying one or more aspects of the present disclosure. In particular, the antenna system includes an antenna 100 operable over or with frequencies from about 698 MHz to about 960 MHz and from about 1710 MHz to about 2170 MHz. For example, the antenna 100 may be operable within a first frequency range from about 698 MHz to about 960 MHz and a second frequency range from about 1710 MHz to about 2170 MHz. Or, for example, the antenna 100 may be operable across a single wide frequency range from about 698 MHz to about 2170 MHz.

The antenna 100 includes a radiating patch element 102, an antenna ground plane 104 spaced apart from the radiating patch element 102, a feeding element 108 electrically coupling (e.g., via proximity coupling or direct galvanic coupling) the radiating patch 102 to a feed point 106, and two shorting elements 110 electrically coupling (e.g., via direct galvanic coupling, etc.) the radiating patch element 102 to the antenna ground plane 104. The antenna system may be referred to as a two port antenna.

In this example, the radiating patch element 102 (or more broadly, a radiating surface or radiator) is positioned substantially in the center of the antenna ground plane 104. Such configurations may allow the antenna 100 to have desirable radiation patterns for frequencies within one or more bands (e.g., from 698 MHz to 960 MHz and from 1710 MHz to 2170 MHz, etc.), provide omnidirectional characteristics, etc. Alternatively, the radiating patch element 102 may be positioned in another suitable location (e.g., off-center, etc.) relative to the antenna ground plane 104 if desired.

The radiating patch element 102 may have an annular rectangular shape, such that the radiating patch element has an outer perimeter that is substantially rectangular, with an open interior portion (e.g., a ring shape, etc.). The interior perimeter may also be substantially rectangular. Although FIGS. 1 and 2 illustrate an example radiating patch element shape, other embodiments may include radiating patch element(s) having different shapes.

Figure 7:
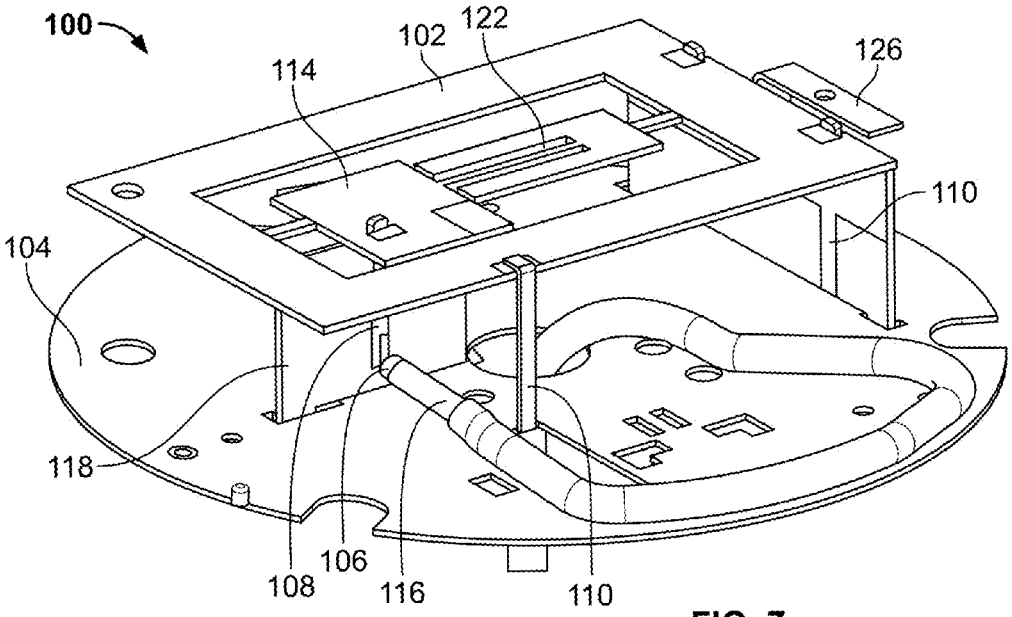
FIG. 7 is a perspective view of a portion of the antenna assembly shown in FIG. 1.

The radiating patch element 102 is also shorted to the antenna ground plane 104 at two locations (e.g., via shorting elements 110, etc.) as shown in FIG. 7. The resonant frequencies ratio in the low frequency band is influenced by the shorting position of the shorting elements 110 and the size of the radiating patch element 102. The position of the shorting elements 110 and the size of the radiating patch element 102 are optimized at about the maximum quarter wavelength of the frequency 698 MHz, which influences the first resonant frequency.

Figure 3:
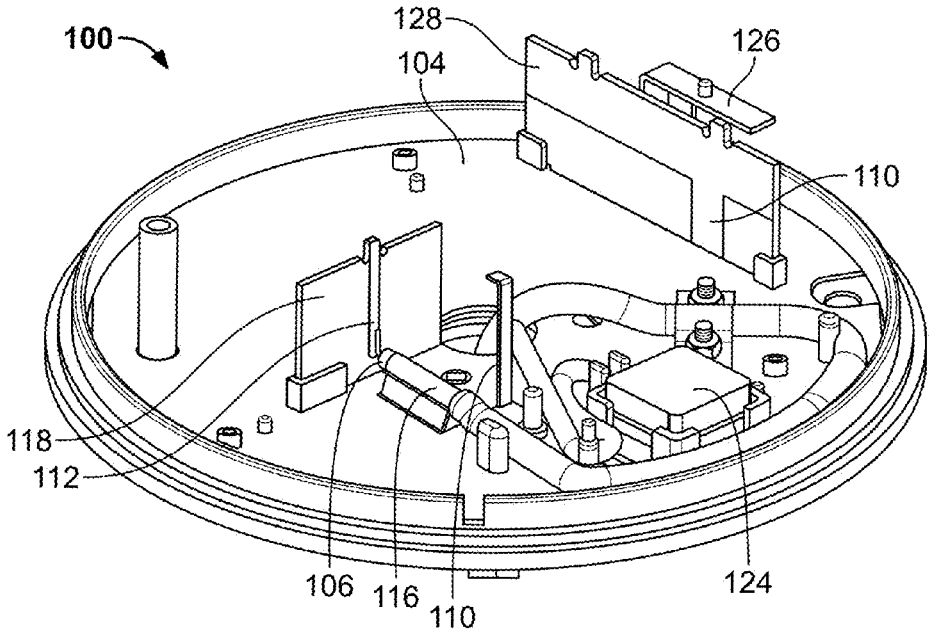
FIG. 3 is a perspective view of a portion of the antenna system shown in FIG. 1.
Figure 4:
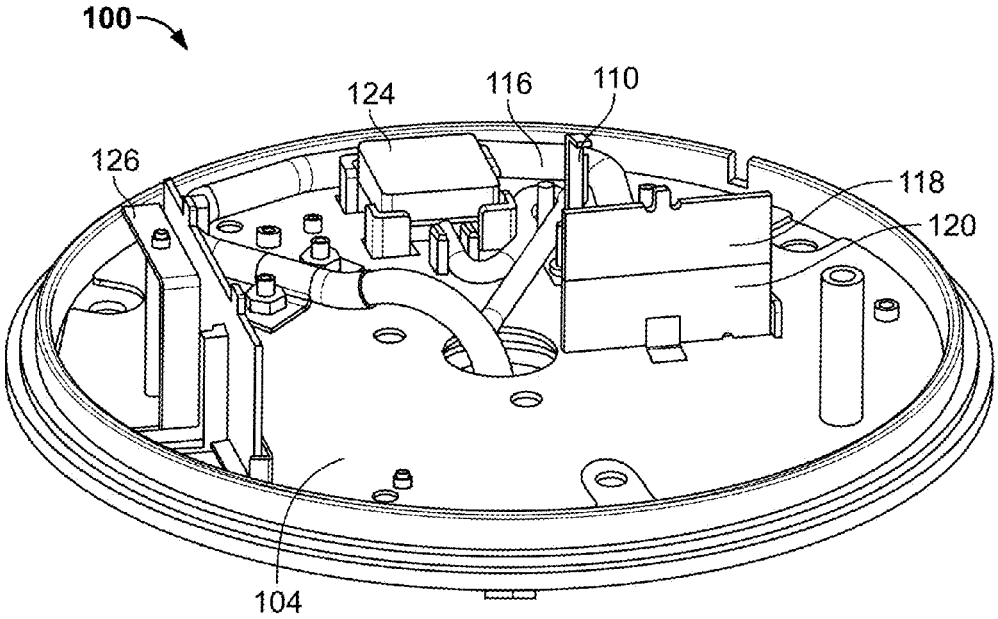
FIG. 4 is a perspective view of the antenna system shown in FIG. 3 rotated about a vertical axis.
Figure 5:
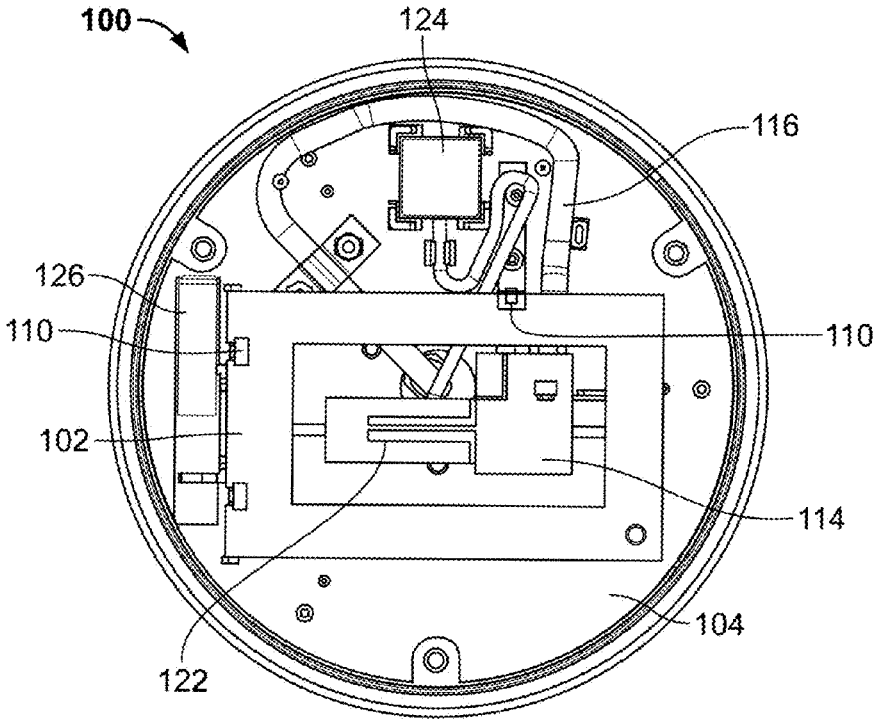
FIG. 5 is a top view of the antenna system shown in FIG. 2 highlighting a horizontal feed patch.

FIGS. 3 and 4 illustrate a portion of the antenna 100, with the radiating patch element 102 removed, in order to further illustrate details of the feeding element 108. As shown in FIG. 3, the feeding element 108 includes a vertical transmission line 112 and a horizontal feed patch 114 (not shown in FIG. 3). The horizontal feed patch 114 is illustrated in FIG. 5. The feed point 106 includes a coaxial probe 116 coupled to the vertical transmission line 112. This feeding configuration may effectively reduce the inductance of a long probe with a capacitive patch, which is the horizontal feed patch 114.

The vertical transmission line 112 is coupled to (e.g., defined on, integral with, etc.) a printed circuit board 118 (PCB). The resonant frequencies ratio in the low frequency band is also influenced by the position of the vertical transmission line 112. The vertical transmission line 112 may be offset to one end of the horizontal feed patch 114 to have the right separation between the resonant frequencies to attain broad bandwidth characteristic. The vertical transmission line PCB 118 includes an extended ground plane 120 on the back of the vertical transmission line PCB 118. As shown in FIG. 4, the extended ground plane 120 may extend to about half of the height of the vertical transmission line PCB 118. In other embodiments, the extended ground plane 120 may extend to more or less than half the height of the vertical transmission line PCB 118. This configuration may improve (e.g., optimize, etc.) the separation between two resonant frequencies in a low frequency band (e.g., 698 MHz to 960 MHz, etc.) of the antenna 100 to attain a broader bandwidth characteristic and further improve impedance matching for a high frequency band (e.g., 1710 MHz to 2170 MHz, etc.).

The feeding element 108 may couple electromagnetic waves to the radiating patch element 102 via capacitive means. There may be a gap between the feeding element 108 and the radiating patch element 102, which may be tuned (e.g., optimized, etc.) to generate a frequency ratio to substantially match the antenna 100 to the desired operating frequency range (e.g., 698 MHz to 960 MHz, 1710 MHz to 2170 MHz, etc.). The gap may be loaded with (e.g., filled with, have dispersed between, etc.) a dielectric material, be air loaded, etc. In some embodiments, air loading may provide a better frequency match for the antenna 100.

Figure 6:
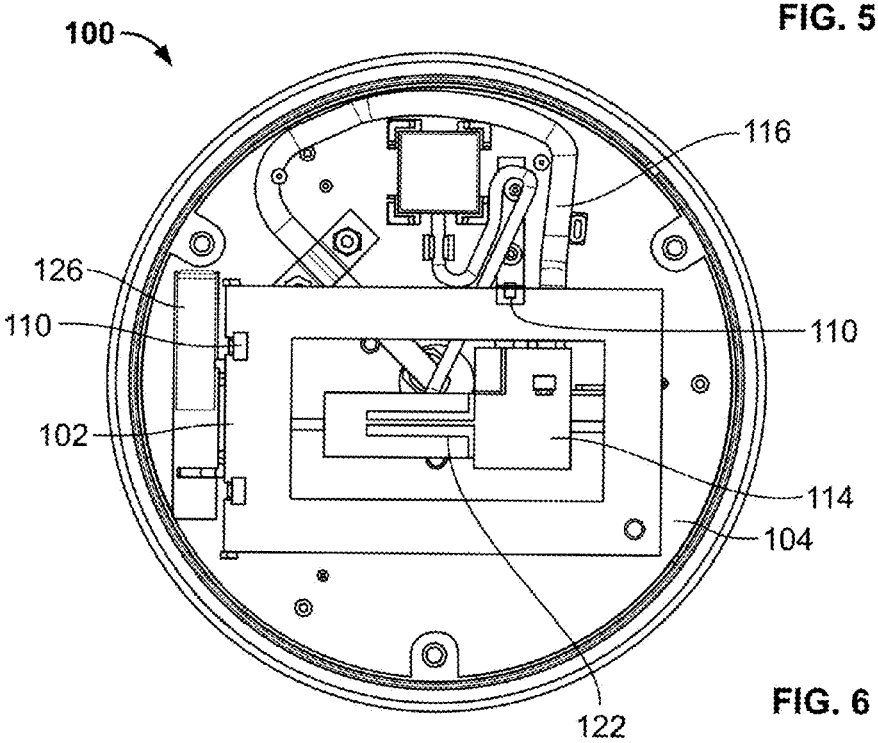
FIG. 6 is another top view of the antenna system shown in FIGS. 2 and 5 illustrating an annular rectangular radiating patch and L-shaped slots.

As shown in FIG. 6, two L-shaped slots 122 defined in the horizontal feed patch 114 may extend the electrical length for the high frequency band. Without the two L-shaped slots 122, the electrical length of the horizontal feed patch 114 may be too short for a frequency of about 1.71 MHz. In other embodiments, the slots 122 may have different shapes, be located in different locations on the horizontal feed patch 114, etc. The gap between the horizontal feed patch 114 and the radiating patch element 102 may be adjusted accordingly to match the high frequency band.

As shown in FIG. 3, a shorting element patch 128 is added to the second shorting element 110 to achieve a better impedance matching. The shorting element patch 128 may shorten the electrical path of the signal and change the antenna impedance for the first resonant at the low frequency band.

Figure 8:
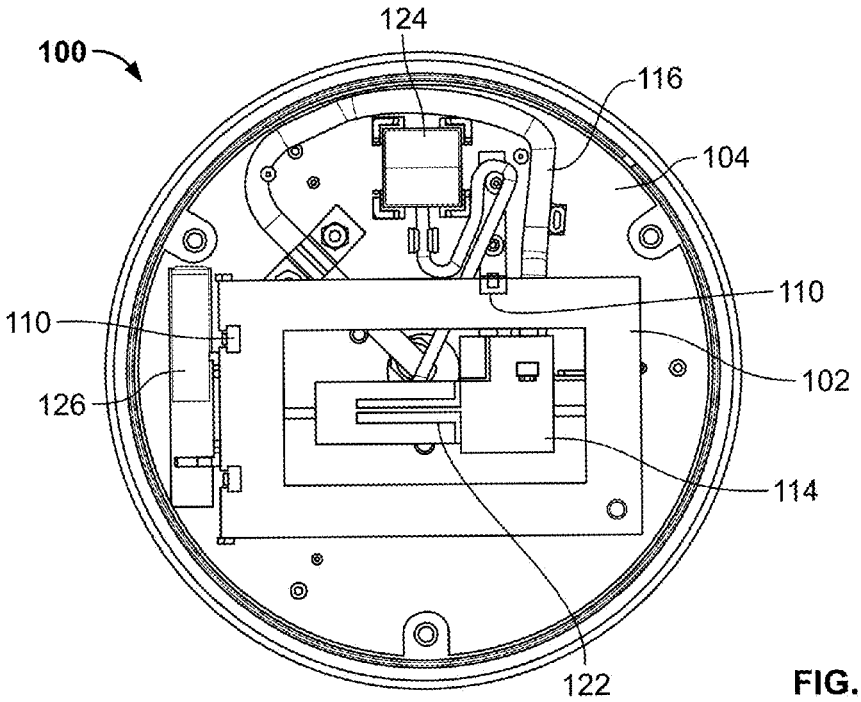
FIG. 8 is another top view of the antenna system shown in FIGS. 2, 5 and 6 illustrating a close spacing between an active GPS antenna and a cellular antenna.
Figure 9:
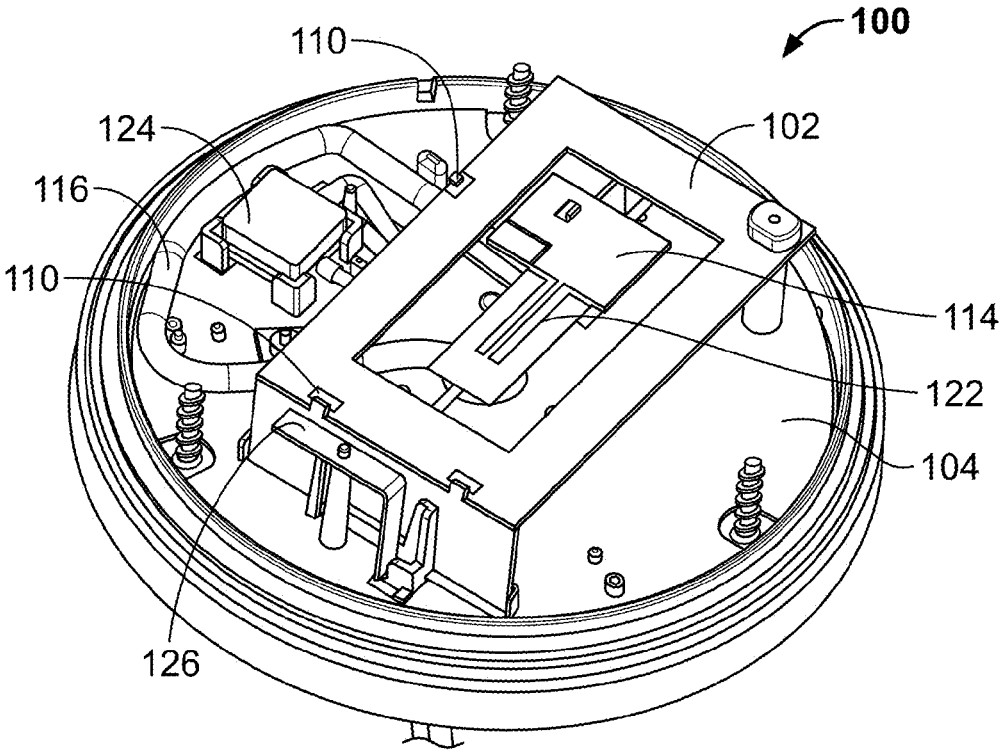
FIG. 9 is a perspective view of the antenna system shown in FIG. 1 rotated about a vertical axis.

As shown in FIGS. 8 and 9, the antenna 100 may include an active GPS antenna 124, which may be positioned adjacent or closely spaced to the passive radiating patch element 102. The antenna 100 also includes an isolator 126 to improve isolation between the active GPS antenna 124 and the passive radiating patch element 102. For example, the isolator 126 may provide an improvement of about −5 decibels (dB) at a frequency of about 1575 MHz.

Figure 10:
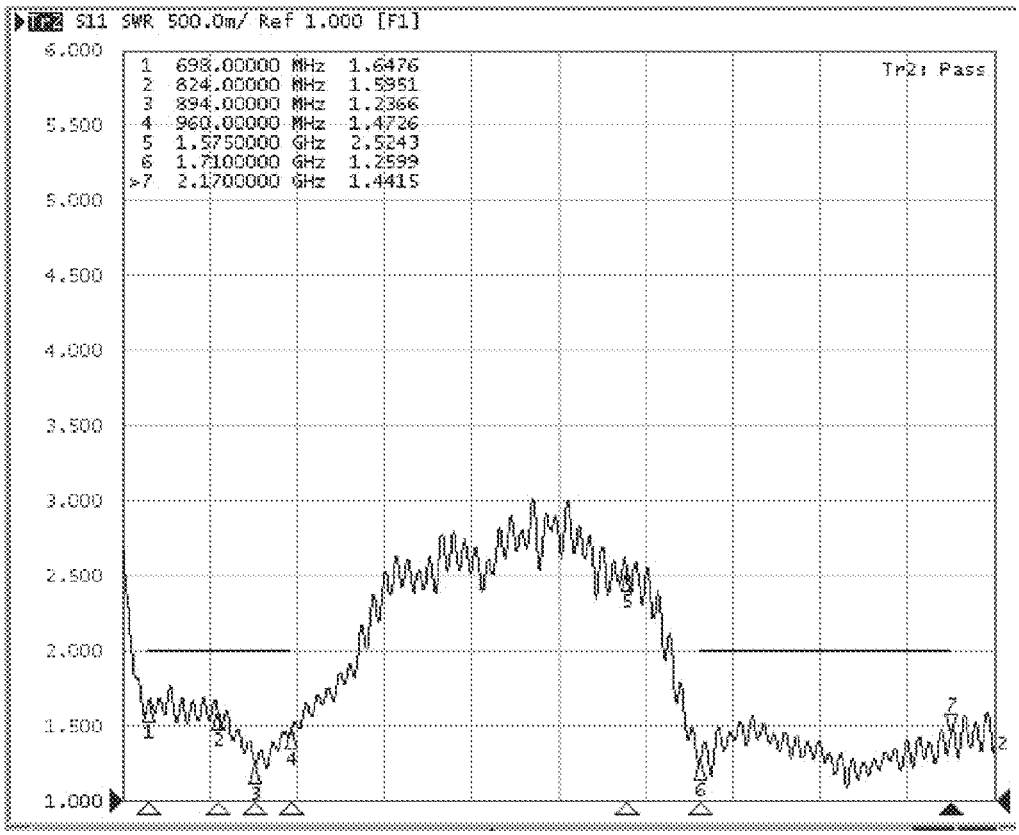
FIG. 10 is an exemplary line graph illustrating VSWR versus frequency measured from the exemplary antenna system of FIGS. 1-9.

FIGS. 10-12 provide results measured for the antenna 100 shown in FIGS. 1-9. These results shown in FIGS. 10-12 are provided only for purposes of illustration and not for purposes of limitation.

More specifically, FIG. 10 is an exemplary line graph illustrating voltage standing wave ratio (VSWR) versus frequency measured for the antenna 100. Generally, FIG. 10 shows that the antenna 100 is operable with relatively good VSWR for the operating bandwidths (e.g., about 698 MHz to about 960 MHz and about 1710 MHz to about 2170 MHz).

FIG. 11*a* illustrates isolation between the active GPS antenna 124 and the passive radiating patch element 102 in decibels (dB) versus frequency measured for the antenna 100 without the isolator 126. For comparison, FIG. 11*b* illustrates the isolation between the active GPS antenna 124 and the passive radiating patch element 102 in decibels (dB) versus frequency measured for the antenna 100 with the isolator 126. Generally, a comparison of FIGS. 11*a* and 11*b* shows the improvement in isolation that may be realized when the isolator 126 is included in the antenna 100. For example, the isolation was about −8 decibels for a frequency of 1.575 GHz with the isolator as compared to about −2.8 decibels without the isolator.

FIG. 12 illustrates various radiation patterns for the antenna 100. More specifically, FIG. 12 illustrates co-polarization components and cross-polarization components (dotted line) of the radiation patterns for the azimuth plane (on the left) and phi 0° plane (on the right) at frequencies of 698 MHz, 824 MHZ, 960 MHz, 1710 MHz, 1880 MHz, 1990 MHz, and 2170 MHz. Generally, FIG. 12 illustrates a radiation pattern in the near horizon that can be identified as a vertically polarized antenna.

FIGS. 13 and 14 illustrate another exemplary embodiment of an antenna system or assembly embodying one or more aspects of the present disclosure. In particular, the antenna system includes an antenna 1300 operable over or with frequencies from about 698 MHz to about 960 MHz and from about 1710 MHz to about 2170 MHz. For example, the antenna 1300 may be operable within a first frequency range from about 698 MHz to about 960 MHz and a second frequency range from about 1710 MHz to about 2170 MHz. Or, for example, the antenna 1300 may be operable across a single wide frequency range from about 698 MHz to about 2170 MHz.

The antenna 1300 includes a radiating patch element 1302, an antenna ground plane 1304 spaced apart from the radiating patch element 1302, a feeding element 1308 electrically coupling (e.g., via proximity coupling or direct galvanic coupling) the radiating patch 1302 to a feed point 1306, and two shorting elements 1310 electrically coupling (e.g., via direct galvanic coupling, etc.) the radiating patch element 1302 to the antenna ground plane 1304.

In this example, the radiating patch element 1302 (or more broadly, a radiating surface or radiator) is positioned substantially in the center of the antenna ground plane 1304. Such configurations may allow the antenna 1300 to have desirable radiation patterns for frequencies within one or more bands (e.g., from 698 MHz to 960 MHz and from 1710 MHz to 2170 MHz, etc.), provide omnidirectional characteristics, etc. as explained above. Alternatively, the radiating patch element 1302 may be positioned in another suitable location (e.g., off-center, etc.) relative to the antenna ground plane 1304 if desired.

The radiating patch element 1302 may have an annular rectangular shape, such that the radiating patch element has an outer perimeter that is substantially rectangular (e.g., one or more edges may have a slightly curved shape as in FIGS. 13 and 14, etc.), with an open interior portion (e.g., a ring shape, etc.). The interior perimeter may also be substantially rectangular. Although FIGS. 13 and 14 illustrate an example radiating patch element shape, other embodiments may include radiating patch element(s) having different shapes.

The radiating patch element 1302 is also shorted to the antenna ground plane 1304 at two locations (e.g., via shorting elements 1310, etc.) as shown in FIG. 7. The resonant frequencies ratio in the low frequency band is influenced by the shorting position of the shorting elements 1310 and the size of the radiating patch element 1302. The position of the shorting elements 1310 and the size of the radiating patch element 1302. are optimized to at about the maximum quarter wavelength of the frequency 698 MHz, which influences the first resonant frequency.

FIGS. 15 and 16 illustrate a portion of the antenna 1300, with the radiating patch element 1302 removed, in order to further illustrate details of the feeding element 1308. As shown in FIG. 15, the feeding element 1308 includes a vertical transmission line 1312 and a horizontal feed patch 1314 (not shown in FIG. 15). The horizontal feed patch 1314 is illustrated in FIG. 17. The feed point 1306 includes a coaxial probe 1316 coupled to the vertical transmission line 1312. This feeding configuration may effectively reduce the inductance of a long probe with a capacitive patch, which is the horizontal feed patch 1314.

The vertical transmission line 1312 is coupled to (e.g., defined on, integral with, etc.) a printed circuit board 1318 (PCB). The resonant frequencies ratio in the low frequency band is also influenced by the position of the vertical transmission line 1312. The vertical transmission line 1312 may be offset to one end of the horizontal feed patch 1314 to have the right separation between the resonant frequencies to attain broad bandwidth characteristic. The vertical transmission line PCB 1318 includes an extended ground plane 1320 on the back of the vertical transmission line PCB 1318. As shown in FIG. 16, the extended ground plane 1320 may extend to about half of the height of the vertical transmission line PCB 1318. In other embodiments, the extended ground plane 1320 may extend to more or less than half the height of the vertical transmission line PCB 1318. This configuration may improve (e.g., optimize, etc.) the separation between two resonant frequencies in a low frequency band (e.g., 698 MHz to 960 MHz, etc.) of the antenna 1300 to attain a broader bandwidth characteristic and further improve impedance matching for a high frequency band (e.g., 1710 MHz to 2170 MHz, etc.).

The feeding element 1308 may couple electromagnetic waves to the radiating patch element 1302 via capacitive means. There may be a gap between the feeding element 1308 and the radiating patch element 1302, which may be tuned (e.g., optimized, etc.) to generate a frequency ratio to substantially match the antenna 1300 to the desired operating frequency range (e.g., 698 MHz to 960 MHz, 1710 MHz to 2170 MHz, etc.). The gap may be loaded with (e.g., filled with, have dispersed between, etc.) a dielectric material, be air loaded, etc. In some embodiments, air loading may provide a better frequency match for the antenna 1300.

As shown in FIG. 18, two tapered L-shaped slots 1322 defined in the horizontal feed patch 1314 may extend the electrical length for the high frequency band. Without the two tapered L-shaped slots 1322, the electrical length of the horizontal feed patch 1314 may be too short for a frequency of about 1.71 MHz. In other embodiments, the slots 1322 may have different shapes, be located in different locations on the horizontal feed patch 1314, etc. The gap between the horizontal feed patch 1314 and the radiating patch element 1302 may be adjusted accordingly to match the high frequency band.

As shown in FIG. 19, a shorting element patch 1328 is added to the second shorting element 1310 to achieve a better impedance matching. The shorting element patch 1328 may shorten the electrical path of the signal and change the antenna impedance for the first resonant at the low frequency band.

The antenna ground plane 1304 may include a long, open-ended slot 1330 to improve impedance matching to provide an improved margin on the VSWR. There is also a small slot on the antenna ground plane 1304 to create an additional shorting element, which may bend from the antenna ground plane 1304 without adding extra antenna parts, and may not have any effect on radio frequency (RF) performance of the antenna 1300.

FIGS. 20 and 21 provide results measured for the antenna 1300 shown in FIGS. 13-19. These results shown in FIGS. 20 and 21 are provided only for purposes of illustration and not for purposes of limitation.

More specifically, FIG. 20 is an exemplary line graph illustrating voltage standing wave ratio (VSWR) versus frequency measured for the antenna 1300. Generally, FIG. 20 shows that the antenna 1300 is operable with relatively good VSWR for the operating bandwidths (e.g., about 698 MHz to about 960 MHz and about 1710 MHz to about 2170 MHz).

FIG. 21 illustrates various radiation patterns for the antenna 1300. More specifically, FIG. 21 illustrates co-polarization components and cross-polarization components (dotted line) of the radiation patterns for the azimuth plane (on the left) and phi 0° plane (on the right) at frequencies of 698 MHz, 824 MHz, 894 MHz, 960 MHz, 1710 MHz, 1880 MHz, 1990 MHz, and 2170 MHz. Generally, FIG. 21 illustrates a radiation pattern in the near horizon that can be identified as a vertically polarized antenna.

The antenna systems disclosed herein including the radiating patch elements, the antenna ground planes, feeding elements, the shorting elements, etc., may be any suitable size (e.g., height, diameter, etc.). The size of each component of an antenna system may be determined based on particular specifications, desired results, etc. For example, the height of the feeding elements disclosed herein may be determined so that an impedance match in the high band may be substantially achieved.

Additionally, the shape of each component of the antenna systems may be any suitable shape. For example, the radiating patch elements, feeding elements, shorting elements, etc. may be square, oval, pentagonal, etc. depending on manufacturability of a shape, cost effectiveness, particular specifications, desired results, etc.

Further, although the antenna systems disclosed herein are shown to include one antenna, two antennas, or four antennas, any number of antennas may be employed without departing from the present disclosure. For example, an antenna system may include three antennas, five or more antennas, etc.

Exemplary embodiments of the antenna systems disclosed herein may be suitable for a wide range of applications, e.g., that use more than one antenna, such as LTE/4G applications, vehicular antenna systems, and/or infrastructure antenna systems (e.g., customer premises equipment (CPE), terminal stations, central stations, in-building antenna systems, etc.). An antenna system disclosed herein may be configured for use as an omnidirectional MIMO antenna, although aspects of the present disclosure are not limited solely to omnidirectional and/or MIMO antennas. An antenna system disclosed herein may be implemented inside an electronic device, such as machine to machine, vehicular, in-building unit, etc. In which case, the internal antenna components would typically be internal to and covered by the electronic device housing. As another example, the antenna system may instead be housed within a radome, which may have a low profile. In this latter case, the internal antenna components would be housed within and covered by the radome. Accordingly, the antenna systems disclosed herein should not be limited to any one particular end use.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific numerical dimensions and values, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An antenna comprising:

a radiating patch element having an outer perimeter that is substantially rectangular and an open interior portion that is substantially rectangular; an antenna ground plane spaced apart from the radiating patch element; a feeding element electrically coupling to the radiating patch element, and at least two shorting elements electrically coupling the radiating patch element to the antenna ground plane;

wherein the feeding element includes a vertical transmission line and a horizontal feed patch, and the feeding element electrically couples the radiating patch element to a feed point;

wherein the horizontal feed patch of the feeding element includes at least two L-shaped slots or at least two tapered L-shaped slots configured to extend an electrical length of a high frequency band of the antenna.

2. The antenna of claim 1, wherein the antenna is operable within at least a first frequency range from about 698 megahertz to about 960 megahertz and a second frequency range from about 1710 megahertz to about 2170 megahertz.

3. The antenna of claim 1, wherein the feeding element is electrically coupled to the radiating patch element via proximity coupling.

4. The antenna of claim 1, wherein:

the location of the vertical transmission line is offset towards one end of the horizontal feed patch of the feeding element; or the feed point includes a coaxial probe coupled to the vertical transmission line.

5. The antenna of claim 1, wherein the feeding element includes a printed circuit board (PCB) having the vertical transmission line on a first side and an extended ground plane on a second side opposite the first side.

6. The antenna of claim 5, wherein the extended ground plane extends to about half the height of the PCB.

7. The antenna of claim 1, wherein a gap between the horizontal feed patch and the radiating patch element is loaded with a dielectric or air-filled substrate.

8. The antenna of claim 1, wherein the location of the two shorting elements is configured to create an electrical path of about a quarter wavelength of the frequency of about 698 megahertz.

9. The antenna of claim 1, wherein the radiating patch element includes an interior perimeter that is substantially rectangular and that defines the open interior portion, and wherein one or more edges along the outer perimeter of the radiating patch element are curved.

10. The antenna of claim 9, further comprising an isolator next to the radiating patch element.

11. The antenna of claim 10, wherein the isolator is configured to provide an isolation improvement of about −5 decibels at about 1575 megahertz.

12. The antenna of claim 1, wherein the antenna is operable to radiate with a vertical polarization at horizon, or wherein the antenna includes an active global positioning satellite (GPS) antenna.

13. The antenna of claim 1, wherein:

at least one of the shorting elements includes a shorting element patch configured to improve impedance matching; or the antenna ground plane includes an open-ended slot configured to improve impedance matching.

14. An antenna comprising:

a radiating patch element having a rectangular shape;

an antenna ground plane spaced apart from the radiating patch element;

a feeding element electrically coupling to the radiating patch element; and at least two shorting elements electrically coupling the radiating patch element to the antenna ground plane;

wherein the feeding element includes a vertical transmission line and a horizontal feed patch, and the feeding element electrically couples the radiating patch element to a feed point;

wherein the horizontal feed patch of the feeding element includes at least two L-shaped slots or at least two tapered L-shaped slots configured to extend an electrical length of a high frequency band of the antenna.

15. An antenna system comprising:

an active global positioning satellite antenna;

a passive antenna including a radiating patch element, an antenna ground plane spaced apart from the radiating patch element, a feeding element electrically coupling to the radiating patch element, and at least two shorting elements electrically coupling the radiating patch element to the antenna ground plane; and an isolator next to the radiating patch element;

wherein the radiating patch element includes an outer perimeter that is substantially rectangular and an open interior portion that is substantially rectangular;

wherein the feeding element includes a vertical transmission line and a horizontal feed patch, and the feeding element electrically couples the radiating patch element to a feed point;

wherein the horizontal feed patch of the feeding element includes at least two L-shaped slots or at least two tapered L-shaped slots configured to extend an electrical length of a high frequency band of the antenna.

16. The antenna system of claim 15, wherein the antenna is operable within at least a first frequency range from about 698 megahertz to about 960 megahertz and a second frequency range from about 1710 megahertz to about 2170 megahertz, or wherein the location of the two shorting elements is configured to create an electrical path of about a quarter wavelength of the frequency of about 698 megahertz.

17. The antenna system of claim 15, wherein:

the feeding element includes a printed circuit board (PCB) having the vertical transmission line on a first side and an extended ground plane on a second side opposite the first side, the extended ground plane extending to about half the height of the PCB;

the feed point includes a coaxial probe coupled to the vertical transmission line.

18. The antenna system of claim 15, wherein the radiating patch element includes an interior perimeter that is substantially rectangular and that defines the open interior portion, and wherein one or more edges along the outer perimeter of the radiating patch element are curved.

* * * * *